US005899610A

United States Patent [19]

Enomoto et al.

[11] Patent Number: 5,899,610

[45] Date of Patent: May 4, 1999

[54] IMAGE BEARING BELT AND IMAGE FORMING APPARATUS USING SAME

[75] Inventors: Naoki Enomoto; Akihiko Takeuchi, both of Susono; Toshiaki Miyashiro, Shizuoka-ken; Takaaki Tsuruya, Numazu, all of Japan

[73] Assignee: Canon Kabushiki Kaisha, Tokyo, Japan

[21] Appl. No.: 08/771,306

[22] Filed: Dec. 20, 1996

[30] Foreign Application Priority Data

Dec. 21, 1995 [JP] Japan ..... 7-333311

[51] Int. Cl.[6] ..... G03G 15/01; G03G 15/16

[52] U.S. Cl. ..... 399/302; 399/302

[58] Field of Search ..... 399/302, 308; 430/126

[56] References Cited

U.S. PATENT DOCUMENTS 5,153,654 10/1992 Yuminamochi et al. .
5,177,549 1/1993 Ohtsuka et al. .
5,223,900 6/1993 Yuminamochi et al. .
5,361,126 11/1994 Loonen et al. ..... 399/308
5,390,012 2/1995 Miyashiro et al. .
5,523,829 6/1996 Miyashiro et al. .
5,539,507 7/1996 Miyashiro et al. .
5,572,304 11/1996 Seto et al. ..... 399/313

*Primary Examiner*—Joan Pendegrass
*Attorney, Agent, or Firm*—Fitzpatrick, Cella, Harper & Scinto

[57] ABSTRACT

The present invention provides an image bearing belt wherein a toner image formed on an electrophotographic photosensitive member is temporarily transferred to the image bearing belt and the toner image transferred to the image bearing member is used in a system for transferring the toner image onto a transfer material. It comprises a rubber layer having a thickness of 0.5 mm or more, and a high resistive layer having at a transfer position where the toner image is transferred in an image forming apparatus, a thickness of 100 $\mu$m or less and having an average net resistance value greater than that of the rubber layer at that transfer position by ten times or more, thereby forming a good multi toner image.

34 Claims, 11 Drawing Sheets

STEP 1

STEP 2

STEP 3

STEP 1

STEP 2

STEP 3

STEP 4

IMAGE BEARING BELT AND IMAGE FORMING APPARATUS USING SAME

BACKGROUND OF THE INVENTION

1. Field of the Invention

The present invention relates to an image forming apparatus such as a copying machine having an intermediate transfer belt or a printer having an intermediate transfer belt, in which an image is formed by electrostatically transferring an image formed on an image bearing belt onto a transfer material.

2. Related Background Art

In conventional color image forming apparatuses, various systems such as electrophotographic systems, heat-transfer systems, ink jet systems or the like have been utilized. Among them, image forming apparatuses having the electrophotographic system are superior to other image forming apparatuses from a view point of high speed operation, high image quality and silentness and have recently been used widely.

In such electrophotographic image forming apparatuses, there have been used various methods such as a multi-developing method in which, after color images are superimposed on a surface of a photosensitive member, the images are collectively transferred for image formation, a multi-transfer method in which a development/transfer cycle is repeated, or an intermediate transfer method in which, after various color developed images were once transferred onto an intermediate transfer member successively, the images are collectively transferred onto a transfer material. Among them, the intermediate transfer method has been noticed in the points that there is no color mixing between developing devices and that it can be applied to various media.

The intermediate transfer member may be of roller type or of belt type. An intermediate transfer belt is superior to an intermediate transfer roller in the points that it has greater flexibility than the intermediate transfer roller and that separation ability between the transfer material and the belt (after second transferring) is excellent due to the fact that a curvature of the belt can be increased at a second transfer position where the developed images are collectively transferred onto the transfer material.

In general, the intermediate transfer belt is formed from a resin film made of PVdF, nylon, PET or polycarbonate and having a thickness of 100 to 200 $\mu$m and volume resistivity of about $10^{11}$ to $10^{16}$ $\Omega$m. By using such a thin resin film, since great electrostatic capacity of the order of several hundreds to several thousands of pF can be obtained at a transfer nip, stable transfer current can be achieved.

However, when the intermediate transfer belt having the thickness of 200 $\mu$m or less is repeatedly flexed by support rollers during rotation, wrinkles are formed on the surface of the belt, thereby causing the image uneven. Further, since the belt may be torn through the wrinkles, a service life of the belt is decreased. In addition, since the resin film cannot be extended, if instantaneous great tension is applied to the belt, the belt cannot absorb such a great force, with the result that the belt will be torn. The image forming apparatus is frequently stopped instantaneously due to sheet jam treatment, or inadvertent door open caused by an operator's erroneous operation. In such a case, the intermediate transfer belt may be torn.

Further, if the thickness of the resin film is increased to improve the service life of the belt, the belt cannot follow the driving roller and/or a driven roller to make the rotation of the belt unstable, with the result that misalignment of registration occurs, thereby worsening the image quality of the color image. In addition, since a friction force is small, slip is easily generated, thereby making the drive unstable.

SUMMARY OF THE INVENTION

An object of the present invention is to provide a new intermediate transfer member which can eliminate the drawbacks of the conventional intermediate transfer members made of resin film.

Another object of the present invention is to provide an image forming apparatus using such a new intermediate transfer member.

The other object of the present invention is to provide an intermediate transfer member onto which toner images can effectively be transferred in a superimposed fashion and wherein the toner images can effectively be transferred onto a transfer material, and an image forming apparatus which can output a color toner image with high quality.

To achieve the above object, according to the present invention, there is provided an image bearing belt wherein toner images formed on an electrophotographic photosensitive member are temporarily transferred to the image bearing belt and the toner images transferred to the image bearing member are used in a system in which the toner images are transferred onto a transfer material. It comprises a rubber layer having a thickness of 0.5 mm or more and a high resistive layer having a thickness of 100 $\mu$m or less and an average net resistance value at a transfer position (where the toner images are transferred in an image forming apparatus) greater than that of the rubber layer at that transfer position by ten times or more.

Further, according to the present invention, there is provided an image forming apparatus wherein toner images formed on an electrophotographic photosensitive member are firstly transferred to an image bearing belt temporarily and then the toner images transferred to the image bearing member are transferred onto a transfer material (second transferring). It comprises an electrophotographic photosensitive member movable along an endless path, a toner image forming means for forming a toner image on the photosensitive member, a belt-shaped image bearing member onto which the toner images formed on the photosensitive member are transferred at a first transfer position and including a rubber layer having a thickness of 0.5 mm or more, and a high resistive layer having a thickness of 100 $\mu$m or less and an average net resistance value at the first transfer position (where the toner images are transferred in an image forming apparatus) greater than that of the rubber layer at the first transfer position by ten times or more and a transfer means for transferring the toner images formed on the belt-shaped image bearing member onto the transfer material at a second transfer position.

DETAILED DESCRIPTION OF THE PREFERRED EMBODIMENTS (First Embodiment)

Figure 1:
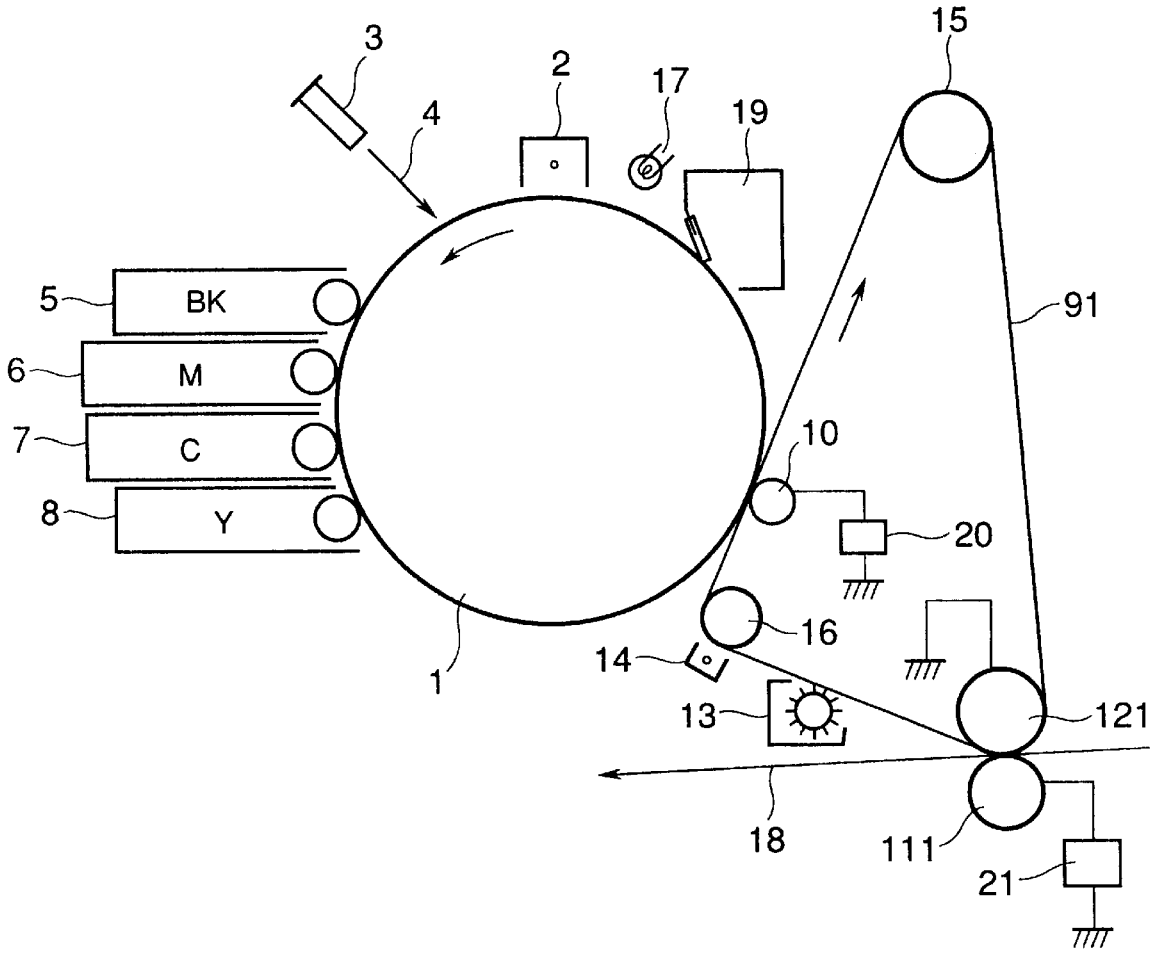
FIG. 1 is a sectional view of an image forming apparatus according to a first embodiment of the present invention.

FIG. 1 shows a color image forming apparatus using an intermediate transfer belt according to the present invention.

Around a photosensitive drum (image bearing member) 1, there are disposed various color developing devices adjacent to each other. These developing devices include a black developing device 5, a magenta developing device 6, a cyan developing device 7 and an yellow developing device 8. A desired developing device to be used for development is selected by a means (not shown) to be contacted with the photosensitive drum. The photosensitive drum 1 is rotated in an anti-clockwise direction. During this rotation, the photosensitive drum is uniformly charged by a first charger 2, and then, latent images are formed on the photosensitive drum with scanning light 4 from a laser exposure optical system 3.

Then, the latent images are developed by the developing devices 5, 6, 7 and 8, and toner images formed on the photosensitive drum 1 are successively transferred onto an intermediate transfer belt (image bearing belt) 91 at a first transfer position by means of a first transfer roller 10. The above-mentioned process is effected successively with respect to the developing devices 5 to 8. When four color toner images are transferred to the intermediate transfer belt 91 (rotated in a clockwise direction) in a superimposed fashion, a transfer material 18 is urged against the transfer belt by a second transfer roller 111, with the result that the toner images are collectively transferred onto the transfer material 18 (second transferring).

The first and second transferring processes will be fully described.

First of all, if the photosensitive drum is constituted by an OHP photosensitive body for effecting the charging with negative polarity, in the illustrated embodiment in which inverse development is effected, when bright portions generated by the exposure of the laser light 4 are developed by the developing devices 5 to 8, toner having negative polarity is used. Thus, in order to transfer the toner images formed on the photosensitive drum onto the intermediate transfer belt, transfer bias having positive polarity is applied to the first transfer roller 10. As the first transfer roller 10, a low resistive roller having volume resistivity of $10^5$ Ω·cm or less is used.

Then, in a second transfer position, an opposed roller 121 is opposed to the second transfer roller 111 and is used as a counter electrode which acts as a support and an electrode and which is earthed or to which appropriate bias is applied. In this case, the second transfer roller 111 to which bias having positive polarity is applied from a bias power source 21 is urged against the counter roller with the inter position of the transfer material 18.

After the above-mentioned processes were finished, the toner remaining on the intermediate transfer belt 91 after the second transferring is removed by a cleaner 13, and, thereafter, electricity is removed from the intermediate transfer belt 91 by means of an electricity removal charger (AC corona charger) 14. In this case, an electrode 16 may be disposed at a back side of the intermediate transfer belt 91 in order to improve electricity removing efficiency.

Incidentally, after the first transferring process, the toner remaining on the photosensitive drum 1 is removed by a cleaner 19 and electricity is removed from the drum by electricity removal exposure 17, thereby preparing for next image formation. In FIG. 1, the reference numeral 16 denotes a tension roller also acting as the electrode; and 15 denotes a drive roller for the intermediate transfer belt.

Next, the intermediate transfer belt 91 according to the illustrated embodiment will be fully explained.

In the illustrated embodiment, in consideration of strength and driving stability, the intermediate transfer belt 91 is formed from a rubber base material 912 having a thickness of 0.8 mm, in place of the conventional resin film.

By the way, since it is difficult to control resistance value of a rubber belt having a thickness of 100 μm or more during the manufacture of the belt, it is not preferable that such a rubber belt is used as an intermediate transfer member in which a high quality image is tried to be formed by superimposing the toner images. If the belt having uneven resistance is used as the intermediate transfer belt, when the transfer bias is applied, current (referred to as "transfer current" hereinafter) flowing through the intermediate transfer belt is not stabilized, thereby making the image uneven.

To avoid this, although constant-current control of the second transfer power source 21 can be performed, but, in this case, since the same current cannot be used for various transfer materials having different thicknesses, features and/or widths, it is practically impossible to adopt the constant-current control. Further, even when the first and second transfer rollers 10, 111 and the opposed roller 121 (at the second transfer position) are formed from rubber, foam urethane or the like, it is difficult to make resistance values of these rollers uniform, with the result that the transfer current becomes unstable by the fluctuation of the resistance values, thereby worsening the image quality of the transferred image.

Figure 2:
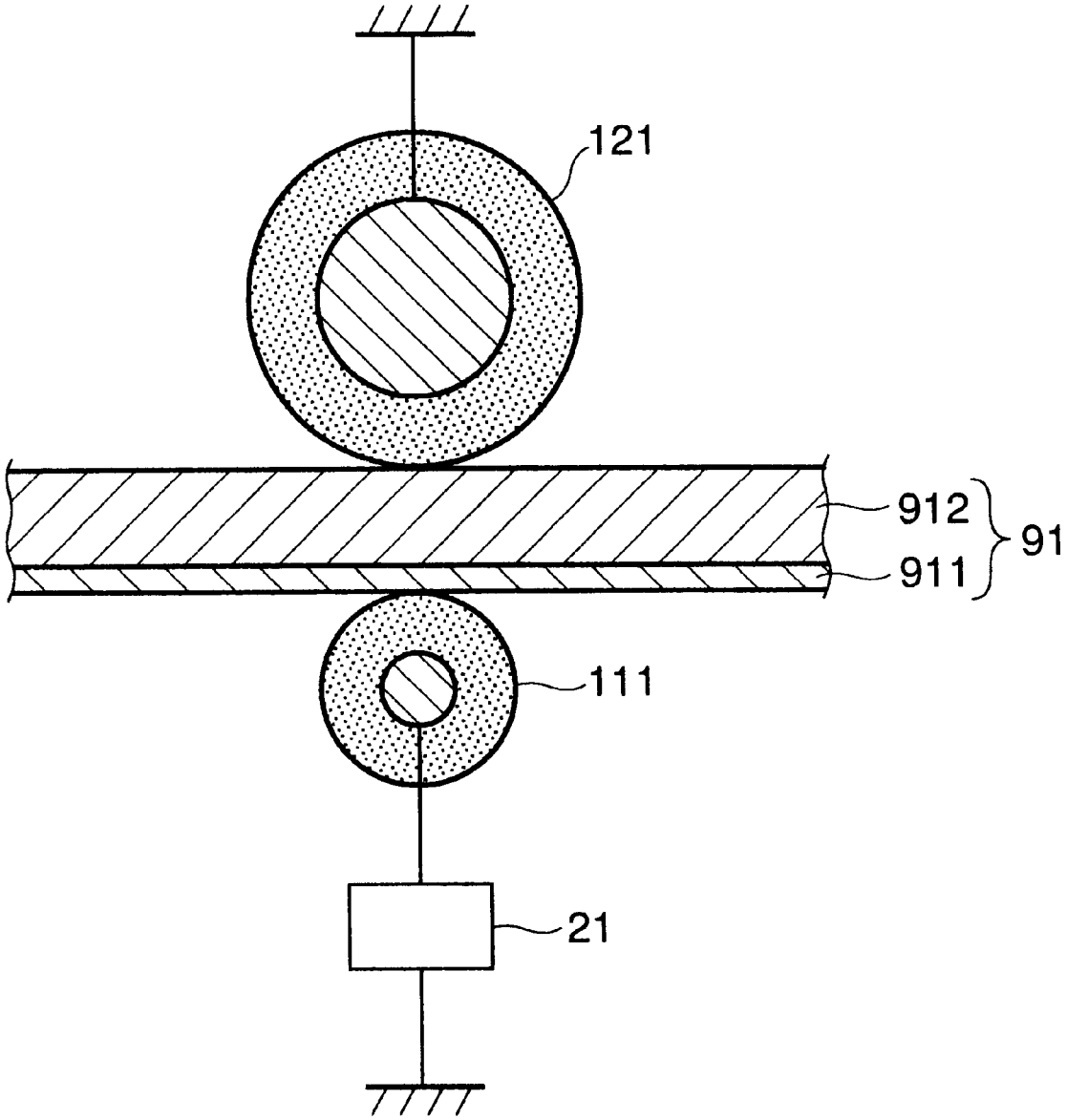
FIG. 2 is a model view showing a second transfer position of the image forming apparatus according to the first embodiment.

FIG. 2 is a model view of the second transfer position according to the illustrated embodiment.

The intermediate transfer belt 91 is constituted by the rubber base material 912 having a thickness of 0.8 mm and made of millable urethane, and a surface layer 911 coated on the base material and having a thickness of 20 μm and obtained by dispersing iron oxide filler into soluble fluoro-material. The coating is effected by a spraying technique, and, after coating, the surface layer is polished by a wrapping film.

The second transfer roller 111 is constituted by a metal core having an outer diameter of 6 mm and an outer layer made of foam urethane and coated on the metal core and having a thickness of 5 mm, and the opposed roller 121 is constituted by a metal core having an outer diameter of 20 mm and an outer layer made of foam urethane and coated on the metal core and having a thickness of 5 mm. The resistance value of the foam urethane used for the outer layers is adjusted to have a desired value by dispersing resistance adjusting agent such as carbon into the foam urethane.

The surface layer 911 of the intermediate transfer belt 91 according to the illustrated embodiment is formed from material having volume resistivity of $2.5\times10^9$ Ω·cm, and an average net resistance value R1 at the second transfer position is $5.0\times10^7$ Ω. Further, the rubber base material 912 of the belt 91 is formed from material having volume resistivity of $7.0\times10^6$ Ω·cm, and an average net resistance value R2 at the second transfer position is $5.0\times10^5$ Ω. The second transfer roller 111 is formed from material having volume resistivity of $2.0\times10^5$ Ω·cm, and an average net resistance value A at the second transfer position is $8.9\times10^4$ Ω. Further, the opposed roller 121 is formed from material having volume resistivity of $5.0\times10^5$ Ω·cm, and an average net resistance value C at the second transfer position is $2.3\times10^5$ Ω.

The net resistance value means a net resistance value value of each member at a nip generated at the second transfer position. These net resistance values were measured by a method shown in FIG. 11, which will be described hereinbelow.

Figure 11:
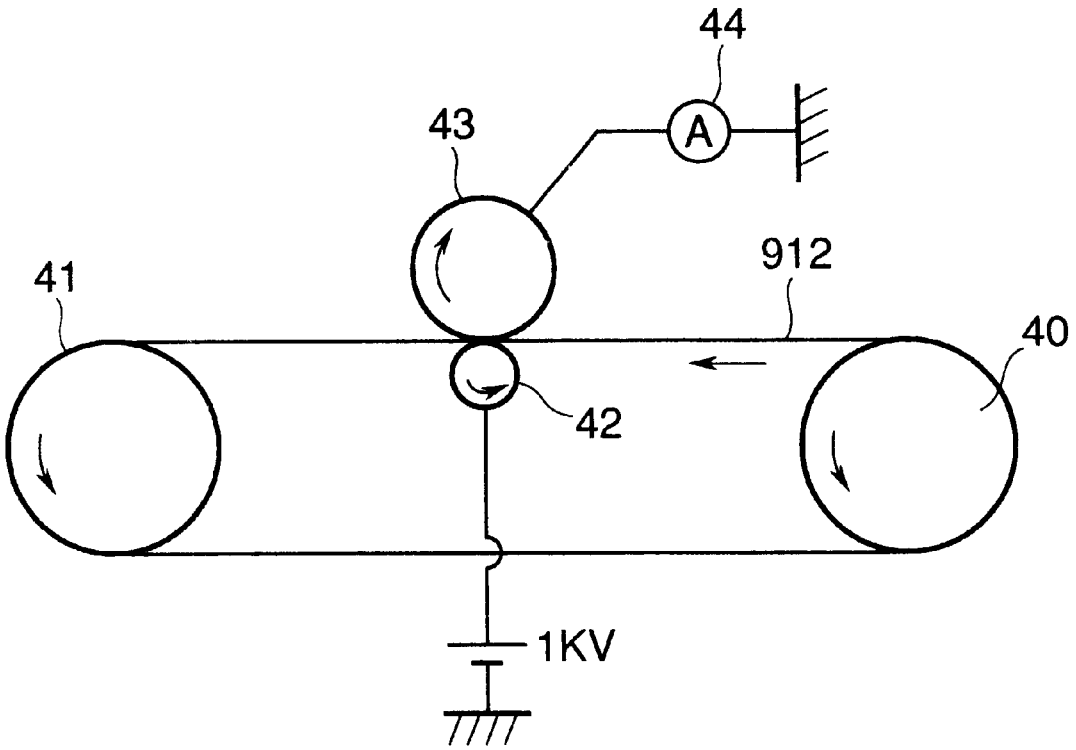
FIG. 11 is a view for explaining a method for measuring a net resistive value.

First of all, only the rubber base material 912*a* is mounted on a drive roller 40 and a driven roller 41 (which are electrically floating) in a belt fashion as shown in FIG. 11, and the rubber base material 912*a* is rotated at a speed of 100 mm/sec substantially the same as a rotational speed of the intermediate transfer belt 91 in the apparatus of FIG. 1. The rubber base material 912*a* is pinched between a metal roller 43 having a diameter of 46.7 mm and earthed via an ampere meter 44 and a metal roller 42 having a diameter of 14 mm and to which voltage of 1 kv is applied, and the net resistance value of the rubber base material 912*a* is obtained by reading a value of the ampere meter 44.

Such measurements of the net resistance value are effected at ten points along a shifting direction of the rubber base material 912*a* and the measured values are averaged to determine the average resistance value of the rubber base material 912.

Then, the measurement of the net resistance value of the belt 91 having the rubber base material 912*a* and the surface layer 911 is similarly performed to determine the average resistance value of the belt. The average resistance value of the surface layer 911 is obtained by subtracting the average resistance value of the belt 91 from the average resistance value of the rubber base material 912. Further, the metal rollers 42, 43 are replaced by the second transfer roller 111 and the opposed roller 121, respectively, and, then, by effecting the similar measurements, the average resistance values of the second transfer roller 111 and the opposed roller 121 are determined.

In the illustrated embodiment, the rubber belt is used as the intermediate transfer belt 91. An advantage of the rubber belt is that, since the rubber belt has elasticity, any wrinkles are not created on the belt during the rotation of the belt. Further, when the thickness of the belt is 0.5 mm or more, if instantaneous great tension is applied to the belt, the tension is absorbed by the elasticity of the rubber, thereby preventing the tearing of the belt.

Further, when the thickness of the belt is 3 mm or less, the belt can follow the drive roller 15 so that the rotation of the belt is stabilized, thereby preventing the deterioration of the image quality due to out-of-synchronization for causing the erroneous reproduction of the superimposed images. In addition, it was found that, by providing fluoro-material having good mold releasing ability on the surface of the intermediate transfer belt 91, the cleaning ability for removing the toner remaining on the belt after the second transferring process can be improved.

Further, although the net resistance of the rubber base layer 912 is changed from $1.5\times10^5$ Ω to $2.7\times10^6$ Ω, the net resistance of the second transfer roller 111 is changed from $7.5\times10^4$ Ω to $8.8\times10^5$ and the net resistance of the opposed roller 121 is changed from $6.5\times10^4$ Ω to $8.9\times10^5$ Ω, in the illustrated embodiment, the apparatus is not influenced by the dispersion of such resistance values and the stable transfer current can be obtained to effect the uniform transferring, thereby obtaining the good image.

Next, a developing mechanism will be explained.

Figure 3:
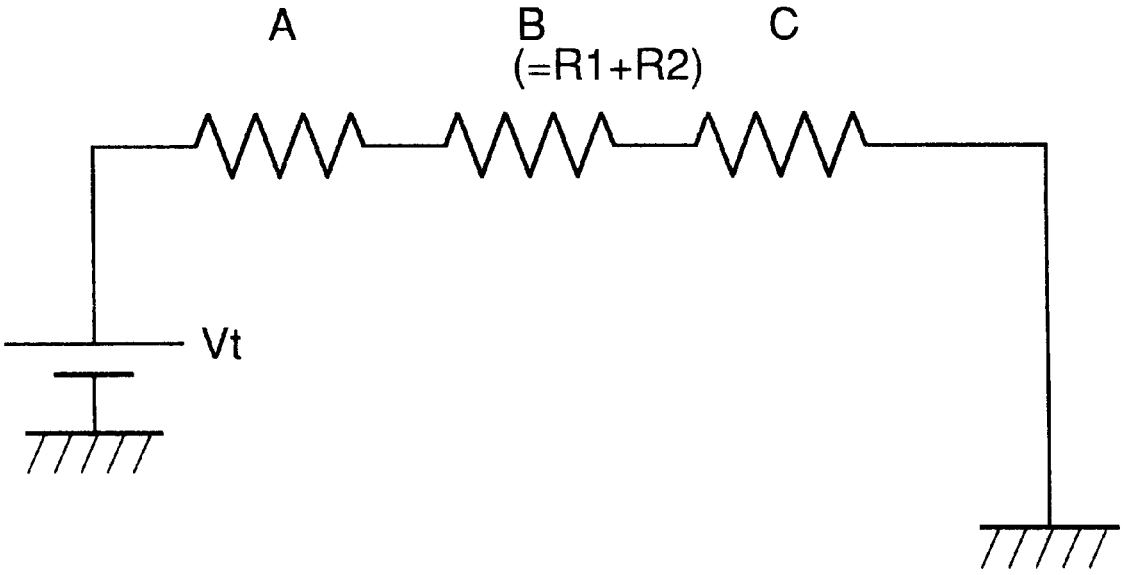
FIG. 3 is an equivalent circuit diagram of the second transfer position according to the first embodiment.

FIG. 3 shows an example of an equivalent circuit for the second transfer position. In FIG. 3, a symbol A denotes the average net resistance of the second transfer roller 111; C denotes the average net resistance of the opposed roller 121; R1 denotes the average net resistance of the surface layer 911; R2 denotes the average net resistance of the rubber base layer 912; and B denotes a value of (R1+R2). A symbol Vt denotes the transfer bias.

A total resistance value of this circuit is (A+B+C), and the transfer current It flowing through the circuit is as follows:

$$It=Vt/(A+B+C)$$

since C is sufficiently small in comparison with B, the following relation can be obtained:

$$B>>A+C$$

Thus, $$(A+B+C)\simeq B$$

Accordingly, the transfer current can be represented as follows:

$$It\simeq Vt/B$$

That is to say, when the net resistance values of the second transfer roller 111 and of the opposed roller 121 are smaller than the net resistance value of the intermediate transfer belt 91, the transfer current It is determined by the net resistance value of the intermediate transfer belt 91.

Figure 4:
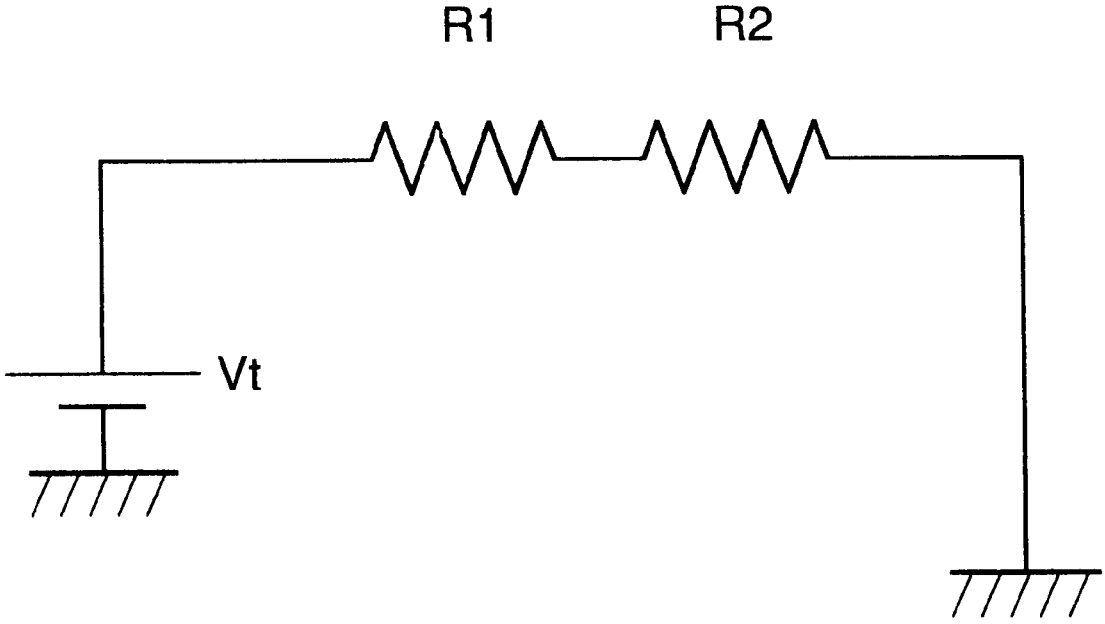
FIG. 4 is another equivalent circuit diagram of the second transfer position according to the first embodiment.

FIG. 4 shows an equivalent circuit for the second transfer position, obtained in consideration of the above relations. In FIG. 4, a symbol R1 denotes the average net resistance of the surface layer 911; and R2 denotes the average net resistance of the rubber base layer 912.

Although It≃(R1+R2)/Vt, since R2 is sufficiently smaller than R1 (i.e., R1>>R2), the following relation can be established:

$$R1+R2\simeq R1$$

Thus, the transfer current can be represented as follows:

$$It\simeq R1/Vt$$

Accordingly, the transfer current It is determined by the average net resistance of the surface layer 911.

By the way, the net resistance of the surface layer 911 is adjusted to a desired value by dispersing the filler into the fluoro-material as the base material. In this method, by using filler having good dispersing ability and by agitating the filler sufficiently, the evenness of the resistance of the surface layer becomes greatly superior to that of the rubber.

Further, in the illustrated embodiment, since the thickness of the surface layer is thin (100 μm or less), even when the rubber is used as the base material for the surface layer 911, it is possible to maintain the evenness of the resistance. Accordingly, the average net resistance value of the surface layer 911 at the second transfer position is selected in such a manner that it becomes greater than the average net resistance value of the rubber base layer 912 at the second transfer position by ten times or more so that the transfer current It is governed by the average net resistance value of the surface layer 911.

Similarly, the average net resistance value of the surface layer 911 at the second transfer position is selected in such a manner that it becomes greater than the average net resistance value of the opposed roller 121 at the second transfer position by ten times or more so that the average net resistance value of the surface layer 911 at the second transfer position becomes greater than the average net resistance value of the second transfer roller 111 at the second transfer position by ten times or more.

In this way, since the transfer current It is determined by the surface layer 911 having the uniform resistance, the transfer current It is stabilized, with the result that the transferring is also stabilized without causing any toner scattering, thereby obtaining the uniform image.

Now, in consideration of productivity of material, capacity of a power source of the apparatus and the like, it is preferable that the average net resistance value of the surface layer 911 is smaller than those of the rubber base layer 912, second transfer roller 111 and opposed roller 121 by 1/1000 time or less and practically has $10^7$ to $10^9$ Ω. Further, in consideration of a service life and bending endurance of the belt, it was found that the thickness of the surface layer 911 is preferably 5 μm or more and 100 μm or less.

Further, in consideration of evenness of the image, prevention of slip of the transfer material at the second transfer position and the like, it was found that average roughness of a central surface of the surface layer 911 (JIS B 0601) is 0.1 to 1.5 μm. The filler for the surface layer 911 is not limited to the iron oxide material as described in the illustrated embodiment, but may be titanium oxide material, fluoro-material, carbon black, graphite, nylon or the like. The base material into which the filler is dispersed may be urethane and the like, as well as the above-mentioned fluoro-material.

(Second Embodiment)

Figure 5:
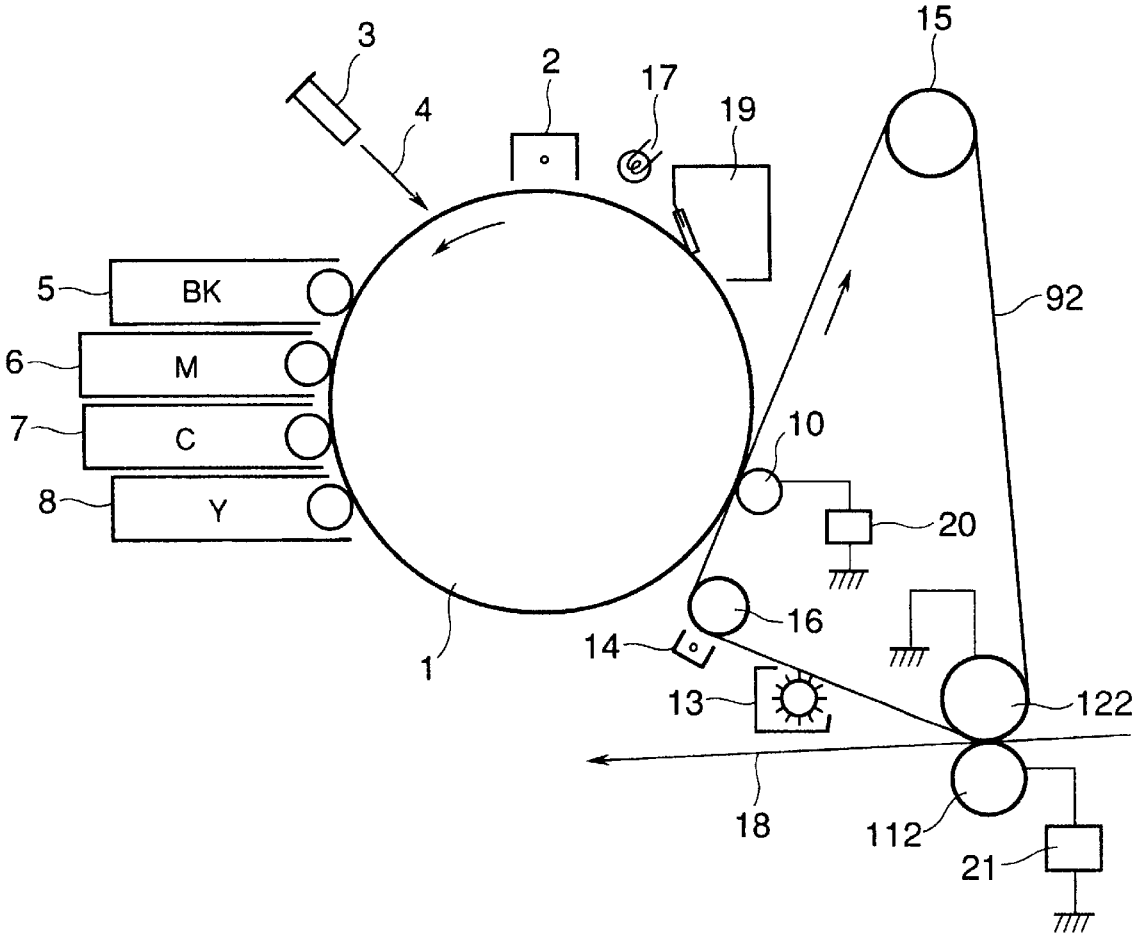
FIG. 5 is a sectional view of an image forming apparatus according to a second embodiment of the present invention.
Figure 6:
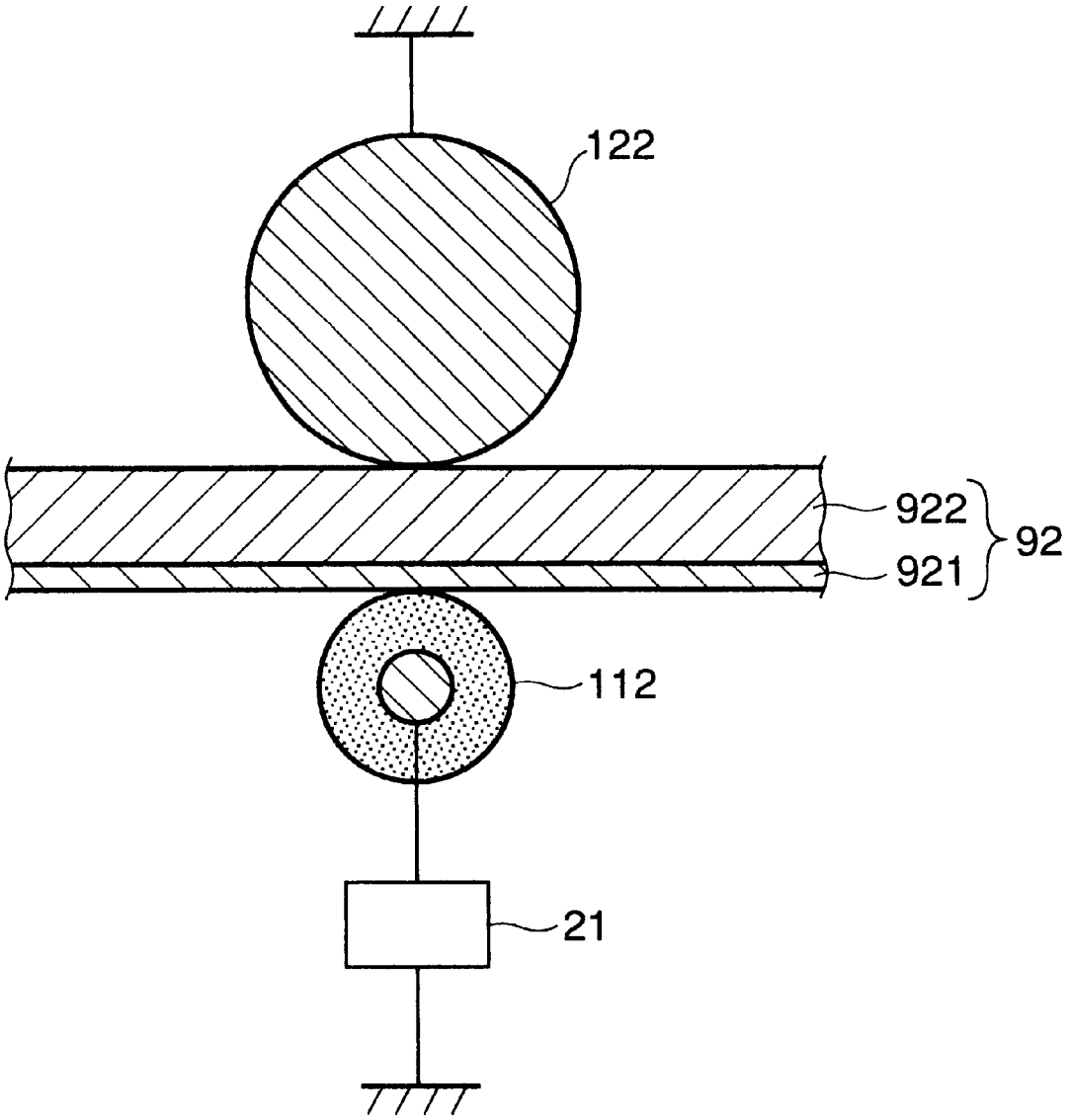
FIG. 6 is a model view showing a second transfer position of the image forming apparatus according to the second embodiment.

FIG. 5 shows an image forming apparatus according to a second embodiment of the present invention, and FIG. 6 is a model view showing a second transfer position of the apparatus of the second embodiment. In the following explanation, the same or similar constructural elements as those of the first embodiment are designated by the same reference numerals and explanation thereof will be omitted.

An intermediate transfer belt 92 according to the second embodiment has a rubber base layer 922 made of urethane having a thickness of 0.7 mm, volume resistivity of $2.0\times10^7$ Ω·cm and an average net resistance value of $1.2\times10^6$ Ω at a second transfer position, and a surface layer 921 obtained by dispersing carbon into thermo-plastic fluoro-material. Further, the surface layer 921 is made of material having volume resistivity of about $1.0\times10^9$ Ω·cm and has an average resistance value of $5.3\times10^7$ Ω. A thickness of the surface layer 921 is 50 μm so that, as explained in the first embodiment, dispersion of resistance of the surface layer 921 is small.

Next, manufacturing processes for the belt 92 will now be explained.

Figure 7A:
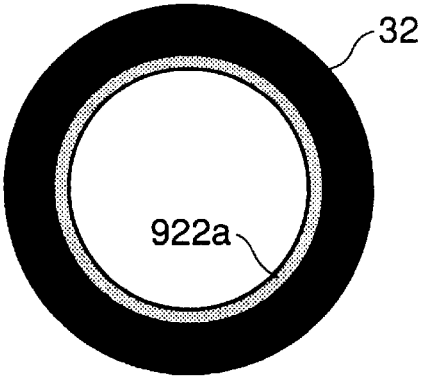
FIGS. 7A to 7C are views for explaining processes for manufacturing an intermediate transfer member according to the second embodiment.
Figure 7B:
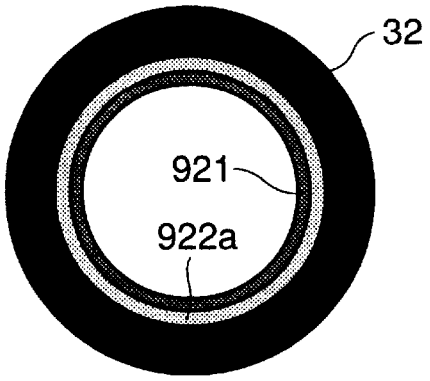
Figure 7C:
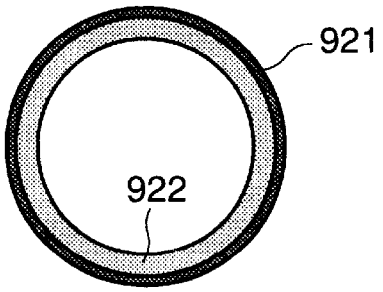

As shown in FIGS. 7A to 7C, rubber base material 922*a* is entered into a centrifugal forming device 32, so that the rubber base material is formed to have a thickness of 0.7 mm (step 1). Then, while remaining the rubber base material 922*a* in the centrifugal forming device 32, material for the surface layer 921 is entered into the centrifugal forming device and is treated, thereby forming the surface layer 921 on the rubber base layer 922 (step 2). Lastly, the belt 92 is removed from the centrifugal forming device 32 and is turned up (step 3).

An opposed roller 122 is constituted by a shaft made of SUS and having a diameter of 30 mm. A second transfer roller 112 is constituted by a metal core having a diameter of 6 mm and a foam urethane layer (having volume resistivity of $1.4\times10^5$ Ω·cm) coated on the metal core. An average net resistance value of the second transfer roller at a second transfer position is $5.0\times10^4$ Ω.

Also in this second embodiment, since a thickness of the intermediate transfer belt 92 is included within a range from 0.5 mm to 3.0 mm and the average net resistance value of the surface layer 921 is selected to be greater than the average net resistance values of the rubber base layer 922 and of the second transfer roller 112 by ten times or more, the service life of the belt is increased and the good image transferring could be achieved without influence of the unevenness of resistance.

Further, in a method used in the second embodiment, since air acts on the surface of the belt during the centrifugal formation, roughness of the surface is greatly reduced, thereby further improving the evenness of the image.

(Third Embodiment)

Figure 8:
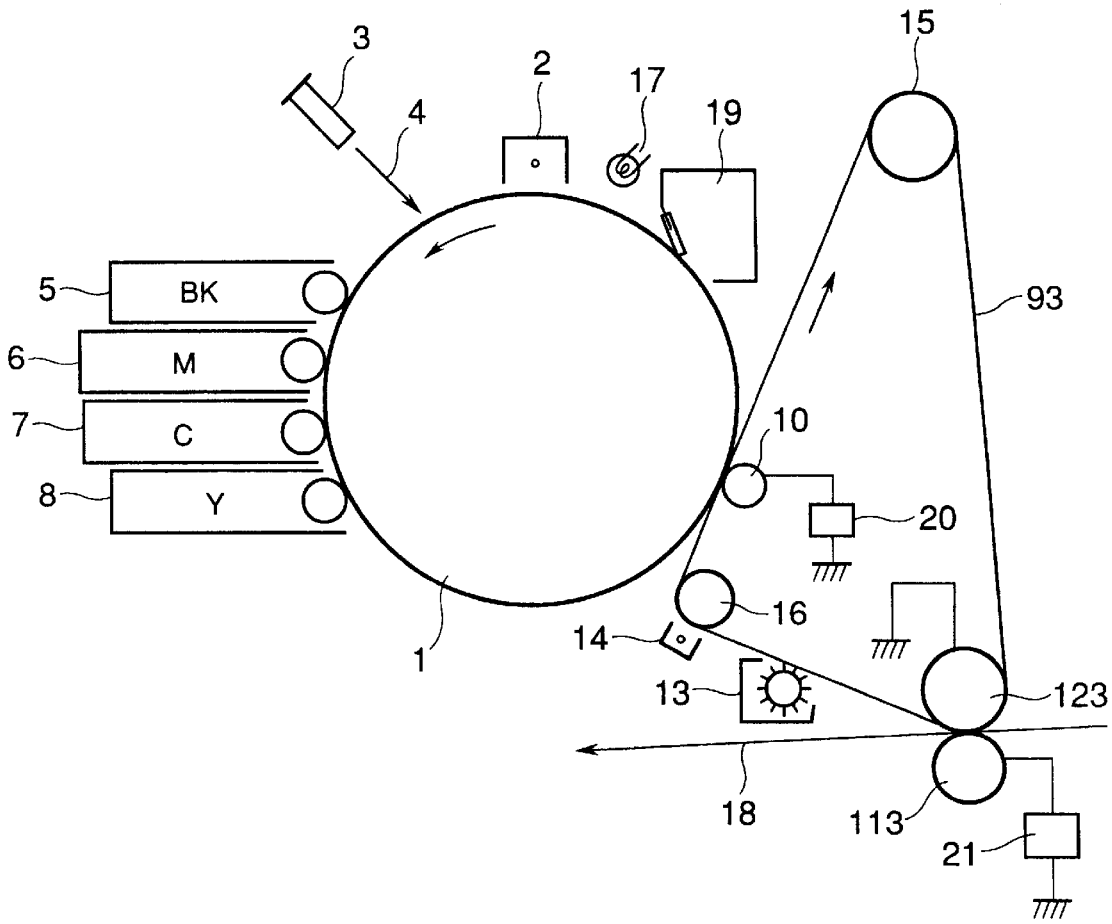
FIG. 8 is a sectional view of an image forming apparatus according to a second embodiment of the present invention.
Figure 9:
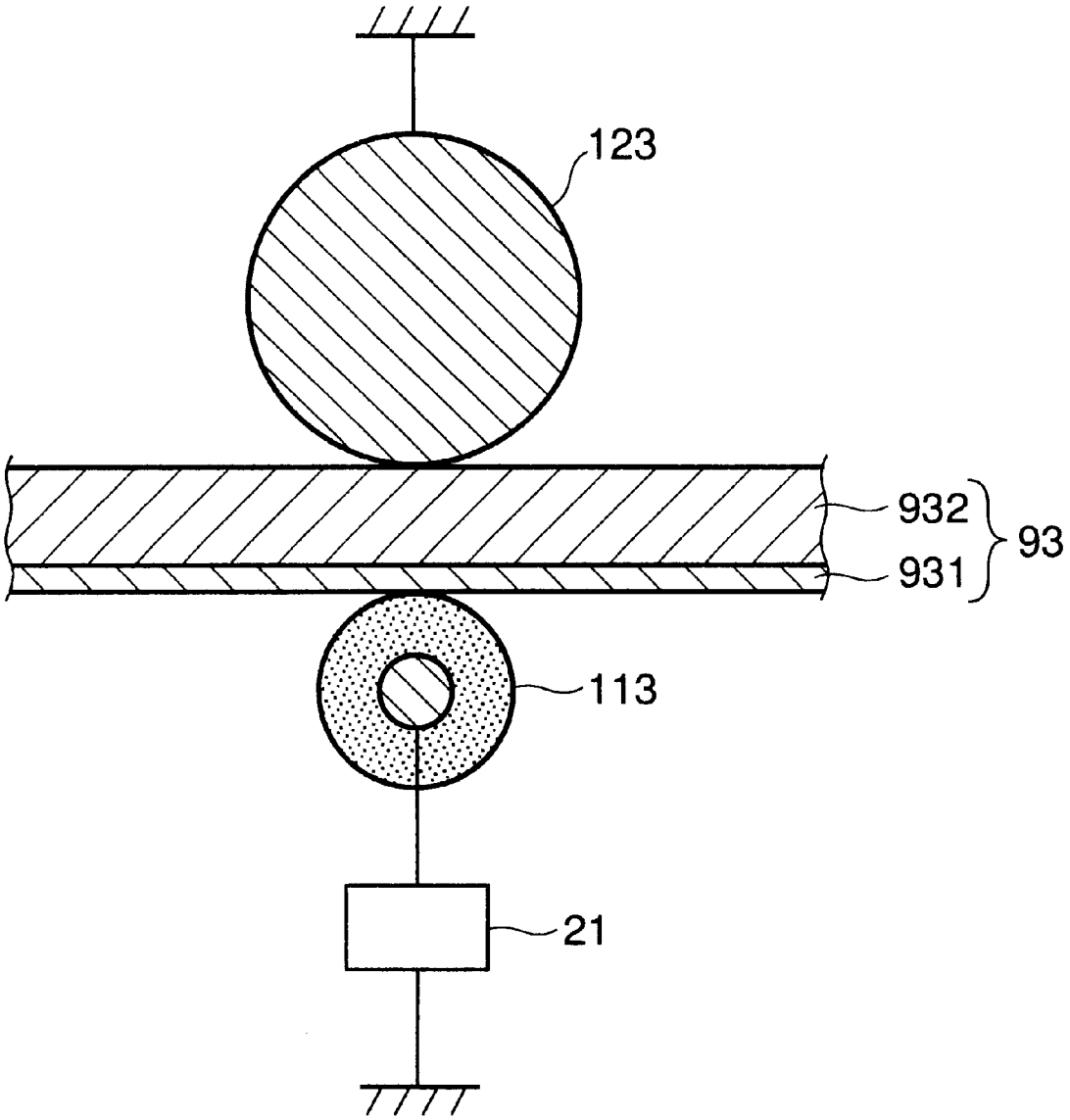
FIG. 9 is a model view showing a second transfer position of the image forming apparatus according to the third embodiment.
Figure 10A:
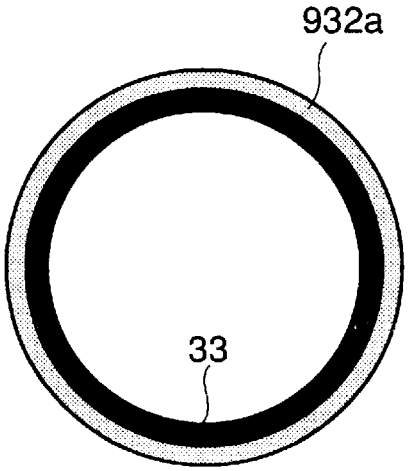
FIGS. 10A to 10D are views for explaining manufacturing processes for manufacturing an intermediate transfer member according to the third embodiment.
Figure 10B:
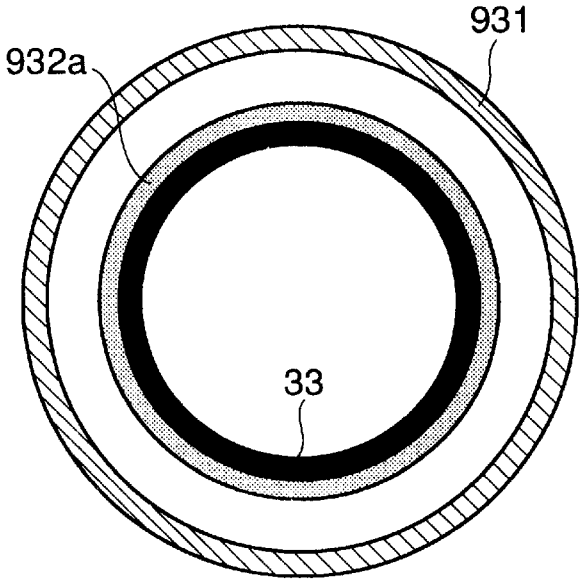
Figure 10C:
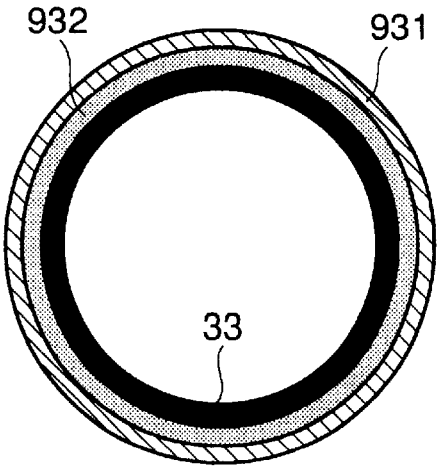
Figure 10D:
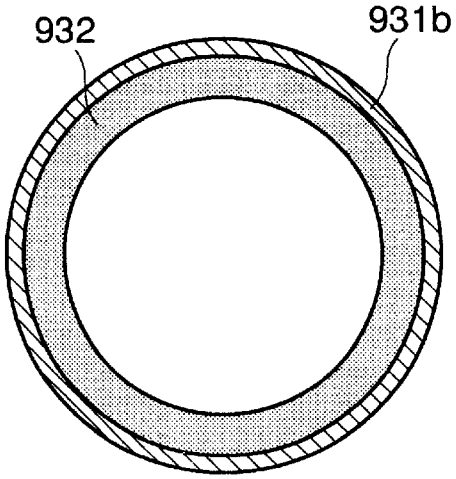

FIG. 8 shows an image forming apparatus according to a third embodiment of the present invention, and FIG. 9 is a model view showing a second transfer position of the apparatus of the third embodiment. In the following explanation, the same or similar constructural elements as those of the first embodiment are designated by the same reference numerals and explanation thereof will be omitted.

An intermediate transfer belt 93 according to the third embodiment has a rubber base layer 932 made of NBR rubber having a thickness of 0.8 mm, volume resistivity of $3.5\times10^7$ Ω·cm and an average net resistance value of $2.2\times10^6$ Ω at a second transfer position, and a surface layer 931 formed from a heat-shrinkable tube having a thickness of 30 μm, volume resistivity of $3.5\times10^{10}$ Ω·cm and an average net resistance value of $1.0\times10^8$ Ω.

Next, manufacturing processes for the belt 93 will now be explained.

As shown in FIGS. 10A to 10D, rubber base material 932*a* is wound around a cylindrical mold 33. An outer diameter of the mold 33 is equal to an inner diameter of the rubber base material 932*a* (step 1). Then, a heat-shrinkable tube is wound around on the mold 33 with the interposition of the rubber base material 932*a* (step 2). Then, hot air is blown onto the mold 33 to shrink or contract the rube, thereby forming the surface layer 931 on the rubber base material 932 (step 3). Lastly, the belt is removed from the mold 33 (step 4).

An opposed roller 123 is constituted by a shaft made of SUS and having a diameter of 30 mm. A second transfer roller 113 is constituted by a metal core having a diameter of 6 mm and a foam urethane layer (having volume resistivity of $1.4\times10^5$ Ω·cm) coated on the metal core. An average net resistance value of the second transfer roller at a second transfer position is $5.0\times10^4$ Ω.

Also in this third embodiment, since a thickness of the intermediate transfer belt 93 is included within a range from 0.5 mm to 3.0 mm and the average net resistance value of the surface layer 931 is selected to be greater than the average net resistance values of the rubber base layer 932 and of the second transfer roller 113 by ten times or more, the service life of the belt is increased and the good image transferring could be achieved without influence of the unevenness of resistance. Further, the belt 93 manufactured by this method is characterized that an anti-wear feature of the surface layer of the belt is superior to that of the surface layer of the belt manufactured in accordance with the first embodiment (coated by the spraying technique).

As mentioned above, according to the present invention, since the image bearing belt includes the rubber layer having the thickness of 0.5 mm or more, the service life of the belt can be improved. Further, the image bearing belt includes the high resistive layer having the average net resistance value (at the transfer position) greater than that of the rubber layer by ten times or more and the thickness of 100 $\mu$m or less, even if there is substantial dispersion of net resistance value in the rubber layer, the good transferring can be achieved.

What is claimed is:

1. An image bearing belt wherein a toner image formed on an electrophotographic photosensitive member is temporarily transferred thereonto, and then the toner image completed at said image bearing belt is used in a system for transferring the toner image onto a transfer material, comprising:

a rubber layer having a thickness of at least 0.5 mm; and a high resistive layer having at a transfer position, where the toner image is transferred in an image forming apparatus, a thickness of 100 $\mu$m or less and having an average net resistance value greater than that of said rubber layer by ten times or more, wherein average roughness of a central surface of said high resistive layer is in a range from 0.1 $\mu$m to 1.5 $\mu$m.

2. An image bearing belt according to claim 1, wherein the average net resistance value of said high resistive layer at said transfer position is greater than that of said rubber layer at said transfer position by 1000 times or less.

3. An image bearing belt according to claim 2, wherein the average net resistance value of said high resistive layer at said transfer position is in a range from $1.0\times10^7$ Ω or more to $1.0\times10^9$ Ω or less.

4. An image bearing belt according to claim 1, wherein said rubber layer has a thickness of 3.0 mm or less.

5. An image bearing belt according to claim 1, wherein said high resistive layer has a thickness of 5 $\mu$m or more.

6. An image bearing belt according to claim 1, wherein said high resistive layer is made of fluoro-material.

7. An image bearing belt wherein a toner image formed on an electrophotographic photosensitive member is temporarily transferred thereto and then the toner image completed at said image bearing belt is used in a system for transferring the toner image onto a transfer material, comprising:

a rubber layer having a thickness from 0.5 mm to 3.0 mm; and a high resistive layer having at a transfer position where the toner image is transferred in an image forming apparatus, a thickness from 5 $\mu$m to 100 $\mu$m and having an average net resistance value greater than that of said rubber layer by times in a range from ten times to 1000 times, wherein average roughness of a central surface of said high resistive layer is in a range from 0.1 $\mu$m to 1.5 $\mu$m.

8. An image bearing belt according to claim 7, wherein said high resistive layer is made of fluoro-material.

9. An image forming apparatus wherein a toner image formed on an electrophotographic photosensitive member is firstly transferred to an image bearing member temporarily and then the toner image formed on said image bearing member is transferred onto a transfer material, comprising:

an electrophotographic photosensitive member movable endlessly;

a toner image forming means for forming a toner image on said photosensitive member;

a belt-shaped image bearing member onto which the toner image formed on said photosensitive member is transferred at a first transfer position, and including a rubber layer having a thickness of at least 0.5 mm, and a high resistive layer having at said first transfer position where the toner image is transferred in the image forming apparatus, a thickness of 100 $\mu$m or less and having an average net resistance value greater than that of said rubber layer at said first transfer position by ten times or more; and a transfer means for transferring the toner image formed on said belt-shaped image bearing member onto a transfer material at a second transfer position, wherein average roughness of a central surface of said high resistive layer is in a range from 0.1 $\mu$m to 1.5 $\mu$m.

10. An image forming apparatus according to claim 9, wherein the average net resistance value of said high resistive layer at said transfer position is greater than that of said rubber layer at said transfer position by 1000 times or less.

11. An image forming apparatus according to claim 9, wherein the average net resistance value of said high resistive layer at said transfer position is in a range from $1.0\times10^7$ Ω or more to $1.0\times10^9$ Ω or less.

12. An image forming apparatus according to claim 9, wherein said rubber layer has a thickness of 3.0 mm or less.

13. An image forming apparatus according to claim 9, wherein said high resistive layer has a thickness of 5 $\mu$m or more.

14. An image forming apparatus according to claim 9, wherein said high resistive layer is made of fluoro-material.

15. An image forming apparatus wherein toner images formed on an electrophotographic photosensitive member are firstly transferred to an image bearing belt temporarily and then the toner images formed on said image bearing belt are transferred onto a transfer material, comprising:

an electrophotographic photosensitive member movable endlessly;

a toner image forming means for forming plural color toner images on said photosensitive member;

a belt-shaped image bearing member onto which the toner images formed on said photosensitive member are successively transferred at a first transfer position, and including a rubber layer having a thickness of at least 0.5 mm, and a high resistive layer having at a transfer position where the toner images are transferred in the image forming apparatus, a thickness of 100 $\mu$m or less and having an average net resistance value greater than that of said rubber layer at said transfer position by ten times or more; and a transfer means for collectively transferring the toner images formed on said belt-shaped image bearing member onto a transfer material at a second transfer position, wherein average roughness of a central surface of said high resistive layer is in a range from 0.1. $\mu$m to 1.5 $\mu$m.

16. An image forming apparatus according to claim 15, wherein said transfer means at said second transfer position is constituted by an electrode member contacted with said belt-shaped image bearing member, and an average net resistance value of said transfer means is 1/10 or less of the average net resistance value of said high resistive layer at said second transfer position.

17. An image forming apparatus according to claim 16, wherein the average net resistance value of said transfer means is 1/1000 or more of the average net resistance value of said high resistive layer at said second transfer position.

18. An image forming apparatus according to claim 17, wherein said transfer means at said second transfer position is urged against said image bearing belt by an urging means to form a second transfer means, and the average net resistance value of said second transfer means when urged against said image bearing belt, is 1/10 or less of the average net resistance value of said high resistive layer, at said second transfer position.

19. An image forming apparatus according to claim 18, wherein the average net resistance value of said second transfer means at said second transfer position is 1/1000 or more of the average net resistance value of said high resistive layer at said second transfer position.

20. An image forming apparatus according to claim 15, wherein said high resistive layer is made of fluoro-material.

21. An image forming apparatus wherein toner images formed on an electrophotographic photosensitive member are firstly transferred to an image bearing belt temporarily and then the toner images formed on said image bearing belt are transferred onto a transfer material, comprising:

an electrophotographic photosensitive member movable endlessly;

a toner image forming means for forming plural color toner images on said photosensitive member;

an image bearing belt onto which the toner images formed on said photosensitive member are successively transferred at a first transfer position, and including a rubber layer having a thickness from 0.5 mm or more to 3.0 mm or less, and a high resistive layer having at a transfer position where the toner images are transferred in the image forming apparatus, a thickness from 5 μm or more to 100 μm or less and having an average net resistance value greater than that of said rubber layer at said transfer position by times from ten times ore to 1000 times or less and further having average central surface roughness from 0.1 μm or more to 1.5 μm or less; and a transfer means for collectively transferring the toner images formed on said image bearing belt in a superimposed fashion onto a sheet-shaped transfer material at a second transfer position.

22. An image forming apparatus wherein toner images formed on an electrophotographic photosensitive member are firstly transferred to an image bearing belt temporarily and then the toner images formed on said image bearing belt are transferred onto a transfer material, comprising:

a rotating drum-shaped electrophotographic photosensitive member;

a plurality of developing devices for successively forming plural color toner images on said photosensitive member with plural color toners;

an image bearing belt onto which the toner images formed on said photosensitive member are successively transferred at a first transfer position and including a rubber layer having a thickness from 0.5 mm or more to 3.0 mm or less, and a high resistive layer having at a transfer position where the toner images are transferred in the image forming apparatus, a thickness from 5 μm or more to 100 μm or less and having an average net resistance value greater than that of said rubber layer at said transfer position by times from ten times or more to 1000 times or less and further having average central surface roughness from 0.1 μm or more to 1.5 μm or less;

a means for supplying a sheet-shaped transfer material to said image bearing belt at a second transfer position; and a transfer means for collectively transferring the toner images formed on said image bearing belt in a superimposed fashion onto the supplied sheet-shaped transfer material at said second transfer position.

23. An intermediate transfer member to be used in an image forming apparatus and on which a toner image on an image bearing member is transferred, comprising:

a rubber layer;

a resin layer provided on said rubber layer and having a thickness of 100 μm or less, an average net resistance value of said resin layer being greater than that of said rubber layer by ten times or more, wherein surface roughness of a surface of said resin layer on which the toner image is transferred in range from 0.1 to 1.5 μm.

24. An intermediate transfer member according to claim 23, wherein the average net resistance value of said resin layer is greater than that of said rubber layer by 1000 times or less.

25. An intermediate transfer member according to claim 23, wherein thickness of said resin layer is in range from 5 to 100 μm.

26. An intermediate transfer member according to claim 23, wherein thickness of said rubber layer is in range from 0.5 to 3.0 mm.

27. An image forming apparatus, comprising:

an image bearing member bearing a toner image thereon;

an intermediate transfer member including a rubber layer, and a resin layer provided on the rubber layer and having thickness of 100 μm or less, the toner image on said image bearing member being transferred onto said intermediate transfer member; and transfer member for transferring the toner image on said intermediate transfer member to a transfer material electrostatically, wherein an average net resistance value of the resin layer is greater than those of the rubber layer and said transfer member by at least ten times.

28. An image forming apparatus according to claim 27, wherein the average net resistance value of said resin layer is greater than those of the rubber layer and said transfer means by 1000 times or less.

29. An image forming apparatus according to claim 28, wherein the average net resistance value of said resin layer is in range from $10^7$ to $10^9$ Ω.

30. An image forming apparatus according to claim 28, wherein said transfer means has a roller.

31. An image forming apparatus according to claim 27, wherein surface roughness Ra of a surface of the resin layer on which the toner image is transferred is in range from 0.1 to 1.5 μm.

32. An image forming apparatus according to claim 27, wherein a thickness of the resin layer is at least 5 μm.

33. An image forming apparatus according to claim 27, wherein the resin layer has fluorine.

34. An image forming apparatus according to claim 27, wherein thickness of the rubber layer is in range from 0.5 to 3 mm.

* * * * *

UNITED STATES PATENT AND TRADEMARK OFFICE

CERTIFICATE OF CORRECTION

PATENT NO. : 5,899,610

DATED : May 4, 1999

INVENTOR(S) : NAOKI ENOMOTO, ET AL.

It is certified that error appears in the above-identified patent and that said Letters Patent is hereby corrected as shown below:

COLUMN 1,
Line 55, "image uneven." should read --image to be uneven.--.

COLUMN 3,
Line 30, "an" should read --a--.

COLUMN 8,
Line 53, "rube," should read --tube--.

COLUMN 11,
Line 40, "ore" should read --more--.

Signed and Sealed this

Ninth Day of November, 1999

*Attest:*

*Attesting Officer*

Q. TODD DICKINSON

*Acting Commissioner of Patents and Trademarks*